United States Patent [19]

Thompson

[11] 4,080,165

[45] Mar. 21, 1978

[54] PIECE GOODS DYER AND PROCESS OF DYEING

[75] Inventor: Richard D. Thompson, Cincinnati, Ohio

[73] Assignee: McGraw-Edison Company, Elgin, Ill.

[21] Appl. No.: 730,833

[22] Filed: Oct. 8, 1976

[51] Int. Cl.[2] ..... D06B 3/30

[52] U.S. Cl. ..... 8/158; 8/159; 68/16; 68/58

[58] Field of Search ..... 8/149.1, 149.2, 158, 8/159, 150, 152; 68/5 C, 15, 16, 58, 183, 13 R, 20

[56] References Cited

U.S. PATENT DOCUMENTS

| | | | |
|---|---|---|---|
| 1,395,669 | 11/1921 | Dudley | 68/58 X |
| 3,406,413 | 10/1968 | Ridley | 8/158 |
| 3,765,840 | 10/1973 | Durr et al. | 8/158 X |
| 3,880,583 | 4/1975 | Luckenbach et al. | 8/158 |
| 3,921,308 | 11/1975 | Freze | 68/5 C X |

FOREIGN PATENT DOCUMENTS

| | | | |
|---|---|---|---|
| 1,431,890 | 4/1976 | United Kingdom | 8/149.1 |

*Primary Examiner*—Philip R. Coe
*Attorney, Agent, or Firm*—Charles F. Lind

[57] ABSTRACT

This disclosure teaches a process and machine particularly suited for dyeing at a low liquid to goods ratio synthetic fibers, such as polyesters, orlon, and nylon, or blends of such with cotton, where further there are minimal risks of thermal shock, cracking, or bruising during cool down.

The disclosed apparatus has a tub enclosing the dye bath, spaced air inlet and outlet openings for the tub, and a blower for forcing air through these openings and in close proximity to the dye bath and its surface. This forced venting of the dye bath enclosure with air effectively cools the dye bath quickly but uniformly during the cool down phase of the dye cycle.

Preferably, dampers at the inlet and outlet openings can be closed to minimize the unwanted escape of vapors from the dye bath during the heat up and/or boil phases of the dye cycle; and further can be opened controlled amounts for varying the volume of airflow over the dye bath during cool down. The blower is preferably located in the system downstream of the outlet opening to create a negative pressure over the dye bath itself, which firstly reduces the flash or boil temperature of the dye bath for fast dissipation of heat from the bath, and secondly minimizes leakage of vapors from the apparatus to the nearby ambient.

13 Claims, 1 Drawing Figure

Blower
Fill Water
Pump
Filter
Trap
Steam
Water
Pump

PIECE GOODS DYER AND PROCESS OF DYEING

BACKGROUND OF THE INVENTION

In commercial dyeing of fabric, typically at least when the same is formed as piece goods, the fabric is immersed in an agitated liquid bath of water and appropriate dyes and chemical additives. The actual dye cycle provides that the bath and the goods in the bath are heated from a low inactive temperature, possibly at the infeed tap water conditions of 50° – 80° F, to above the temperature at which the dye strikes or reacts with the fabric. Depending on the fabric and the type of dye used, some dye activity, or migration out of solution to the fabric, might exist at low temperatures near 150°, moderate dye activity usually takes place at higher temperatures near 180° F, and all dye should be exhausted from the solution at boil . . . especially after a dwell time in excess of several minutes. After the dye strike temperature is reached and held the required dwell time, the bath is cooled and drained, and the goods are then rinsed and dried.

Potential factors for rejecting any batch of dyed goods include non-uniform coloring or shading of the goods, poor texture or feel of the goods without the desired fluffiness created by proper mild fiber abrasion during the dye cycle, stretching or bruising of the goods that might occur during a dye cycle having inadequate or excessive bath agitation, or thermal fracturing or cracking of the synthetic fibers occasioned during cool down.

One type of commercially available dye machine is a rotary dyer, having an outer shell holding the dye bath and an inner perforated tub holding the goods to be dyed and rotated through the dye bath. Another type of commercially available dye apparatus is a paddle wheel dyer, where a large tub holds the dye bath and goods, and where the rotating paddle wheel churns the bath to float goods therein. The newly introduced type of commercial available dye machine, known as the SLANT LINE, has an inclined rotatable tub that holds both the dye bath and goods, and further has a pump that circulates the bath through the goods. This latter type is disclosed in my co-pending application Ser. No. 680,231, filed May 12, 1976.

One major problem of most commercially available dye machines is the large amount of water that must be used in order to dye the many varied fabrics with repeatable commercial success. In order to compare different dye cycles, the amount of water required for each dye bath is reduced to a water to goods ratio, obtained by comparing the weight of the dye bath water to the dry weight of the goods to be dyed. In considering the water to goods ratio, the weight of water required to wet out the goods is not considered, nor is the weight of water used to heat and cool the bath. The apparatus for and method of dyeing goods disclosed in my co-pending application Ser. No. 680,231, filed May 12, 1976, operates with a water to goods ratio as low as 2 to 1 and consistently in the range below 7 to 1. This low level dyeing is compared to the water to goods ratios in excess of 10 to 1 and even as high as 20 to 1 more commonly experienced in the rotary and paddle wheel dyers.

In the face of ever increasing costs, low level dyeing represents a significant advancement to the dyeing art, considering only for example the reduced energy costs required to heat the smaller bath to the boil and the reduced chemical costs where specific chemical concentrations are required in the smaller bath. However, the area that yet remains very critical in this low level dyeing apparatus and method is the cool down of the goods from the dye strike temperature at or near the boil through the sensitive range above approximately 156° F where the fabric may yet be thermally unstable.

In this regard specifically, orlon is the most commonly used fabric for men's socks for example, and yet is most critical as to how it must be dyed. Orlon itself is thermoplastic at temperatures in excess of approximately 156° F, so that fiber cracking or fracture can occur upon exposure to too rapidly changing bath temperatures above this. Balling up or knotting of the goods during cool down is particularly problemsome since this only randomly exposes the goods to the bath and almost always results in thermal cracking. Bath agitation frequently can be used to maintain the goods open and thus less subject to thermal cracking, but inadequate or excessive agitation can bruise the fibers and thus by itself is not the solution.

The apparatus disclosed in my co-pending application Ser. No. 680,231 acceptably controls the cool down rate by regulated infeed of cooling water and prompt mixing of this water with the bath exteriorly of the tub, while the pump circulation of the bath through the tub and the agitation of the bath in the rotating tub provide uniform exposure of the goods to the bath. However, even in the face of elaborate and sophisticated controls, the available tolerance of variables is extremely limited.

DETAILED DESCRIPTION OF THE INVENTION

Figure 1:
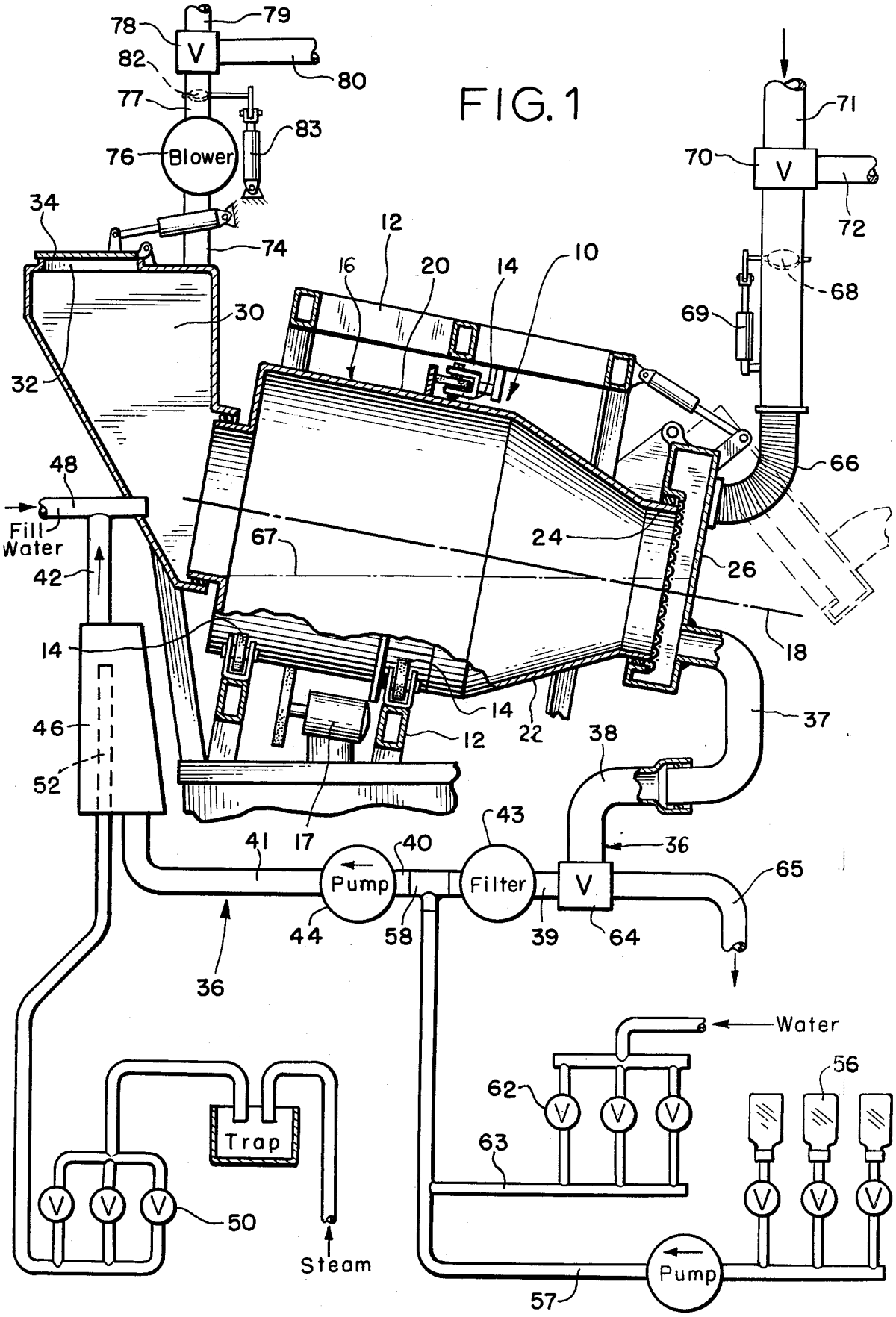

FIG. 1 shows a schematic representation of the subject invention incorporated on a dyer of the type disclosed in co-pending patent application Ser. No. 680,231. This dyer is also structurally similar in many respects to a washing machine disclosed in U.S. Pat. Nos. 3,677,039 and 3,768,282. The dyer 10 has a frame 12 which supports on appropriate rollers 14 a tube 16 powered by motor 17 for rotation about an axis 18 inclined approximately 6° to 15° relative to the horizontal. The ends of the tub 16 are opened, and as illustrated the tub has a cylindrical portion 20 at the upper end and a frustural conical portion 22 narrowing down to a smaller discharge opening 24 at the lower end. A door 26 pivoted to the frame 12 can be moved by a power cylinder to an open position (shown in phantom) for dumping the goods out the discharge opening and a closed position across and sealing the open end 24 of the tub. Appropriate seals (not shown) between the door and the tub allow tub rotation relative to the stationary door while yet maintaining a liquid tight closure for the tub opening.

A hopper 30 mounted to the frame adjacent the open upper end of the tub 16 cooperates across appropriate seals (not shown) to allow tub rotation relative to the stationary hopper while yet establishing a direct communication to the interior of the tub. The hopper has a top opening 32 that allows the direct dumping of goods from an overhead conveyor or the like for rapid loading of goods into the tub. A door 34 hinged to the hopper can be opened and closed by a power cylinder the closed door minimizing the escape of heat or vapors from the tub during the dye cycle.

There also is provided on the exterior of the tub a closed loop circuit 36 including lines 37, 38, 39, 40, 41, and 42, and components such as a valve 64, a filter 43, pump 44 and heat exchanger 46. The tub can initially be filled with water through main fill line 48, where the pump then circulates the liquid in a direction to be withdrawn from the tub through line 37 and discharged back into the tub through lines 42 and 48. Line 37 might be carried by the door to communicate past a screened opening in the door with the tub, and seals (not shown) could allow for the separable connection of the line 37 moving with the door and the line 38 mounted on the frame 12.

Steam can be admitted through control valves 50 for discharge from line 52 into the heat exchanger 46 for direct admixture with the bath liquid therein and common discharge from the lines 42 and 48 to the tub. The steam heats the bath liquid to above the strike temperature of the dye and typically even to the boil, and the continuous circulation of the bath through the tub and the closed loop circuit 36 helps maintain the bath temperature substantially uniform. The rate of bath circulation found most desirable would be one bath change at least every one to three minutes.

Chemical additives stored in the various tanks 56 can be pumped via line 57 to the exterior closed loop circuit 36 at tee 58, which is upstream of the pump 44. There further is provided means for metering water into the closed loop circuit for maintaining the dye bath level and for supplemental cooling of the bath during cool down as will be noted. A water line thus communicates through control valves 62 and line 63 for admixture through the tee 58 into the circuit 36. Therefore normal pump operation mixes and blends the additives or the added water with the circulating bath in the pump itself and in the heat exchanger before initial infeed into the tub from lines 42 and 48.

The control valves 50 and 62 for the steam and water respectively, are provided in parallel lines of various sizes, which by their own resistance admit only specified quantities of the respective fluid, so that by opening certain of these valves varying infeed rates of heating steam and/or cooling water can be obtained.

The valve 64 in the circuit between lines 38 and 39 also is used when shifted to divert the bath through line 65 to a drain or to a holding tank (not shown) during the normal operation of the dyer.

The disclosed tub 16 is shelless in that it holds both the goods to be dyed and the bath liquid directly. The bath in the tub would be generally near the lever indicated at 67, which might approach the upper quarter of the door, and this would extend the bath back into the cylindrical portion 20 of the tub. Radial vanes (not shown) located on the interior of the tub can be used in order to agitate the goods and the bath within the tub upon tub rotation. A tub having a diameter at section 20 of approximately 45 to 50 inches for example might preferably be rotated between 7 and 20 r.p.m. to provide reasonably uniform agitation of the bath and goods.

The dyer has, at its low end adjacent the outlet opening, an air inlet tube 66 which opens into the tub enclosure above the maximum bath level 67. A damper plate 68 pivoted to the tube can be closed to block off the tube, or can be opened varied amounts to allow some communication up to the maximum. A power cylinder 69 connected between the damper and the tube allow for the automatic remote operation of the damper as desired. A diverter valve 70 can be used to open the line 66 to line 71 extended to the atmosphere outside the building housing the dyer or to line 72 merely ambient the dyer.

The dyer at the upper end of the tub coming off the top hopper wall also has an outlet air tube 74 which communicates through a blower 76 to line 77. Line 77 connects through diverter valve 78 to line 79 that would discharge to outside the building housing the dyer and to line 80 would merely discharge to ambient the dyer. A damper 82 in the line 77 can be opened and closed by power cylinder 83.

To perform a dye cycle, the goods are loaded into the tub and the tub is filled to a specified level with low temperature water and with the appropriate dye and/or chemical additives. The bath temperature is increased, by discharging steam directly into the bath to above the strike temperature of the dye and typically to the liquid boil, where transfer of the dye from solution takes place onto the goods. The rate at which the transfer takes place again is controlled by the particular dye and fabric combination in question, but for best results, the bath temperature should be maintained uniform and the goods should be agitated through the bath. After some dwell period, generally between 15 and 20 minutes, for all practical purposes the dye has been exhausted from the bath onto the fabric, and the cool down phase of the dye cycle can begin.

Since the dye bath is heated by direct mixture of steam, the condensate adds to the volume of the bath so that a greater quantity of bath solution is present when cool down can begin than when the dye cycle itself began. Accordingly, the level of bath liquid in the tub might be higher than what might be required, and to this end the excess liquid over a minimum bath volume is drained from the tub by opening the valve 64. However, the bath liquid remaining is constantly being circulated throughout the tub by the pump 44 and the tub is continually being rotated by motor 17 in order to keep the bath uniform throughout the tub.

During the initial stages of cool down the temperature of the bath is near or at the boil so that a significant amount of vapor release occurs, from the agitated bath surface, from the small bath droplets being splashed about inside the tub, and even from the wetted goods and tub structure. Upon opening the dampers 68 and 82 and upon operating the blower 76, cooler air probably at a temperature between 70° and 120° F, is drawn through the inlet tube 66 and tub enclosure and over the agitated bath for passage through the blower 76 and discharge from line 77, preferably to the outside atmosphere via line 79. This draws the bath vapors away from the tub enclosure and discharges them likewise outside of the tub enclosure.

The bath itself is moved axially through the tub by the pump 44, and the air is moved axially through the tub by the blower 76, but in opposite directions, and thus the bath and air each is being changed repeatedly. Moreover, the bath recirculation rate of between one and three change-overs per minute and the recirculation discharge as an ejected stream or spray from line 48 into the oppositely moving cooldown air flow provides continuing atomization of the bath circulation for highly effective heat transfer between the cooling air and bath. This airflow through the bath enclosure also is in immediate proximity to the agitating bath, the tub structure, and even the tumbling goods themselves, and thus has good heat transfer therewith. However, the air has a low thermal coefficient so that the rate of temperature change of the bath liquid is gradual for any instant.

This increases the chances that the goods when in the thermal plastic state are uniformly exposed to a bath, instantaneously at the same temperature, even though the bath throughout the entire cool down cycle is actually dropping in temperature. The airflow further can be reduced below maximum by partially closing the dampers so that the cooling rate of the bath can be accurately controlled.

It is preferred to locate the venting blower 76 downstream in the airflow system of the tub, since this reduces the static pressure in the tub to lower the flash temperature of the bath liquid. It further draws air ambient the dyer into the small unsealed openings in the dyer, instead of forcing steam or vapors from these openings, to keep the atmosphere ambient the dyer cleaner. It would be preferred also to discharge the vented air to the outside atmosphere via pipe 79, rather than cloud up the atmosphere ambient the dyer; but depending on the interior temperature of the building housing the dyer and whether it is in the heating or cooling season, it could possibly be more desirable to use outside atmosphere air for venting in preference to the ambient air, or vice versa.

The preferred mode of operation of the forced enclosure venting during cool down, particularly in the dyeing of critically sensitive fabrics such as orlon, has air cool down solely in the initial phases from the boil to approximately 195° - 200° F. It is at these temperatures that the orlon is highly plastic in character so that it can become thermally shocked most readily when it is subjected in rapid sequence to baths at temperatures dissimilar by more than only a few degrees, such as 3° - 6° F. The air cooling in this most critical temperature therefore helps maintain the bath at instantaneously uniform temperatures throughout, even when the overall bath temperature is dropping.

Below this super critical bath temperature of 195° - 200° F, cooling water might be admitted into the tub as above noted by opening certain of the valves 62, where the water would admix with the bath liquid upstream of the pump for complete temperature blending with the circulating bath before being discharged into the tub itself. As the bath temperature approaches approximately 165° - 170° F, the sensitivity of the fabric toward thermal cracking drops off substantially so that the water infeed rate might be increased as the bath is being cooled. The controlled cool down would continue to an overall bath temperature below the 156° F thermal plastic temperature of the orlon, to perhaps 140° - 150° F, where the entire bath could then be drained. Thereafter the tub can be refilled with cool water and the goods rinsed of surplus dye and chemicals.

By way of example, with a tub having approximately 50 to 60 cubic feet total interior volume, during the initial phase of cool down the liquid bath might comprise 20 to 30 cubic feet, thus leaving a free air space of approximately 20 to 40 cubic feet in the tub enclosure over the bath. The cross section of the tub might comprise 6 to 15 square feet, and the bath might take up from 10 to 70 percent of this depending upon where the section is taken and the height of the bath at this location. The most satisfactory airflow rates through the tub having these general operating dimensions, and using air at 70° - 120° F have been found to be approximately 1,000 to 1,400 CFM; where 750 CFM appears to be a low limit below which quality drops off dramatically and where 1,800 CFM appears to be an upper limit above which increases do not appreciably seem to add to the quality or output of the dye cycle. These airflow rates, as compared to the possible available air spaces within the tub enclosure above the bath, will cause a minimum of approximately 10 air changeovers every minute and possible as many as 100 air changeovers every minute. This also could be compared to having airflow speeds through the bath enclosure and in proximity to the agitating bath of between 60 feet per minute and 800 feet per minute, depending again on the cross section of the tub under consideration.

The practical rate of bath temperature cooling of a difficult fabric such as orlon in a commercial dye cycle appears to be in the range of 1° to 10° F per minute from the boil to approximately 195° - 200° F, and then possibly faster to approximately 165° - 170° F, and still faster to below the thermal plastic temperature of the material, such as to 140° - 150° F. The disclosed forced venting of air proximate the bath provides dye bath cool down accurately and uniformly at this rate, particularly in the most critical temperature ranges immediately below the boil and also with low level dyeing where the goods are more susceptible to balling up. For cooling below the most critical ranges, water also can be bled into the tub as disclosed at initially 1 to 2 gallons per minute and then increased to as many as 5 to 10 gallons per minute to where the bath can be drained. The total cool down cycle of a dye bath might therefore be 5 to 25 minutes, which when consistently practiced allows rapid turnover cycling and efficient utilization of the dyer.

An interesting phenomena which again is most helpful in the disclosed cooling method is that tremendous quantities of energy are dissipated to the atmosphere by the evaporative process so that an equal amount of cooling energy is not required as would typically be the case with a water cooling system only. The evaporative process in actual practice might dissipate anywhere from 15 to 35 percent of the total bath from that at the start of cool down. A typical example might provide that the bath volume at the end of the boil would be 225 to 275 gallons of free liquid, this might be drained to approximately 150 to 200 gallons of liquid before the cool down, while when the bath has been cooled to approximately 195° - 200° F, the total bath might be only 100 to 150 gallons. This means in effect that this cool down dissipated to the atmosphere approximately 50 gallons of liquid. Agreeing that the latent heat of the dissipated vapors is less than the approximately 1,000 btu. per pound of dry steam energy, there nonetheless is a significant cooling effect brought about because of the forced air venting of the bath as disclosed herein.

What is claimed is:

1. A method of dyeing fabric, comprising the steps of exposing the fabric uniformly to an agitating dye bath at a temperature elevated above that where the dye strikes the fabric and for a sufficient dwell period to allow the dye to leave the bath for transfer to the fabric, and then cooling the still agitating dye bath while the goods are still exposed thereto by forcing atmospheric air at a temperature cooler than the bath over and in close proximity to the agitating bath and by then discharging the cooling air to the atmosphere remotely of the bath.

2. A method of dyeing fabric according to claim 1, further wherein the cooling air passes in proximity to the dye bath at a speed in the range between approximately 60 and 800 feet per minute.

3. A method of dyeing fabric according to claim 1, further wherein the bath is contained within an enclosure having confined air space over the bath, and wherein the air flow is through the enclosure and provides between approximately 10 and 100 complete changeovers per minute of air in such space over the bath.

4. A method of dyeing fabric according to claim 3, further wherein the cooling air passes in proximity to the dye bath at a speed in the range between approximately 60 and 800 feet per minute.

5. In a fabric dyeing machine having a tub for holding a dye bath, means for agitating the dye bath, and means for heating the dye bath to above the strike temperature of the dye to the fabric and even to the boil, the improvement comprising means for cooling the dye bath, said last mentioned means consisting of air moving means and means for directing atmospheric air at a temperature cooler than the bath for forced passage sequentially in close proximity to the agitating dye bath and then for discharge remotely of the dye bath, and means for simultaneously circulating the bath as an ejected discharge into the tub and directly into the path of the forced air movement.

6. A fabric dyeing machine, comprising the combination of a tub for holding dye bath, means for heating the dye bath to the boil, means for agitating the dye bath and any goods therein to be dyed, means defining an enclosure above and immediately proximate to the agitating dye bath, spaced inlet and outlet air openings communicating with the enclosure, means for moving atmospheric air at a temperature cooler than that of the dye bath from outside of the enclosure via the inlet opening for forced passage through the dye bath enclosure in close proximity to the agitating dye bath and for discharge remotely of the dye bath via the outlet opening, and said air moving means including a blower located downstream of the outlet opening thereby serving to place the tub enclosure under a subatmospheric pressure.

7. A fabric dyeing machine according to claim 6, wherein the blower has an output relative to the volume of air in the enclosure to provide that there are between approximately 10 and 100 complete changeovers per minute of the air proximate the bath and within the enclosure.

8. A fabric dyeing machine according to claim 6, wherein the blower has an output relative to the cross section of air space in the enclosure above the dye bath to provide that the speed of the cooling air passing in proximity to the agitating dye bath is in the range between approximately 60 and 800 feet per minute.

9. A fabric dyeing machine according to claim 8, wherein the blower output relative to the volume of air in the enclosure also provides between approximately 10 and 100 complete changeovers per minute of the air proximate the bath and within the enclosure.

10. A fabric dyeing machine according to claim 6, further including means for circulating the bath as an ejected discharge into the enclosure and directly into the path of the air movement for effecting heat exchange therebetween.

11. A fabric dyeing machine according to claim 10, further including means for adding cooling water to the bath as a mixture with the ejected bath discharge directly into the path of the air movement, and means for actuating the cooling water adding means only when the bath temperature has cooled to approximately 195°–200° F and for then increasing the rate of adding the cooling water as the bath cools further to approximately 165°–170° F.

12. A method of dyeing fabric according to claim 1, further providing that the bath is simultaneously circulated as an ejected discharge directly into the path of air movement for effecting heat transfer therebetween.

13. A method of dyeing fabric according to claim 12, further providing that cooling water is added to the bath with the ejected discharge directly into the path of air movement for effecting heat transfer therebetween, the addition of said cooling water beginning only after the bath has been cooled to approximately 195°–200° F and only in small quantities initially and then increased quantities as the bath cools until the bath temperature reaches approximately 165°–170° F.

* * * * *